United States Patent [19]

Siemerink et al.

[11] Patent Number: 5,074,427

[45] Date of Patent: Dec. 24, 1991

[54] APPARATUS FOR COVERING A BASIN FOR LIQUIDS

[76] Inventors: Bernardinus F. A. Siemerink, Buitenvest 2, 4931 CH Geertruidenberg, Netherlands; Bastiaan D. F. Piso, Sint Michielweg, 14D, P.O. Box 3132, Curacao, Netherlands Antilles

[21] Appl. No.: 557,119

[22] Filed: Jul. 23, 1990

[30] Foreign Application Priority Data

Jul. 24, 1989 [NL] Netherlands ..... 8901913

[51] Int. Cl.[5] ..... B65D 88/36; B65D 88/38

[52] U.S. Cl. ..... 220/218; 220/219

[58] Field of Search ..... 220/216, 218, 219, 227, 220/902, DIG. 6; 210/538, 525, 242.1

[56] References Cited

U.S. PATENT DOCUMENTS

| | | | |
|---|---|---|---|
| 1,674,039 | 6/1928 | Glass | 220/218 |
| 1,716,491 | 6/1929 | Griffin | 220/219 |
| 3,592,009 | 7/1971 | Alkmaar et al. | 220/219 X |
| 3,874,175 | 4/1975 | Winters | 220/216 X |
| 4,063,395 | 12/1977 | Stewart et al. | 220/902 X |
| 4,202,460 | 5/1980 | Imbeault | 220/218 |
| 4,851,275 | 7/1989 | Yes | 220/216 X |

FOREIGN PATENT DOCUMENTS

| | | | |
|---|---|---|---|
| 3530727 | 3/1987 | Fed. Rep. of Germany | 220/218 |

*Primary Examiner*—Stephen Marcus
*Assistant Examiner*—Vanessa Caretto
*Attorney, Agent, or Firm*—Wells, St. John & Roberts

[57] ABSTRACT

An apparatus for covering a basin for liquids, for instance basins used for purification of waste water. The apparatus according to the invention comprises a covering element, with a regular circumferential shape, so that they can be located adjacent, which covering element floats unto the liquid to be covered. For making the element float a number of floating elements is provided at the lower side of the elements, but these floating elements are not adjacent. Consequently the resulting upward floating force of the floating element keeps the lower side of the covering element on a distance from the surface of the liquid. This distance allows draining or removal of bodies floating on the liquid. Preferably the upper surface of the covering element has the shape of a deepened tray to allow the collection of rain water, so that the elements cannot be blown away.

9 Claims, 2 Drawing Sheets

APPARATUS FOR COVERING A BASIN FOR LIQUIDS

Figure 1:
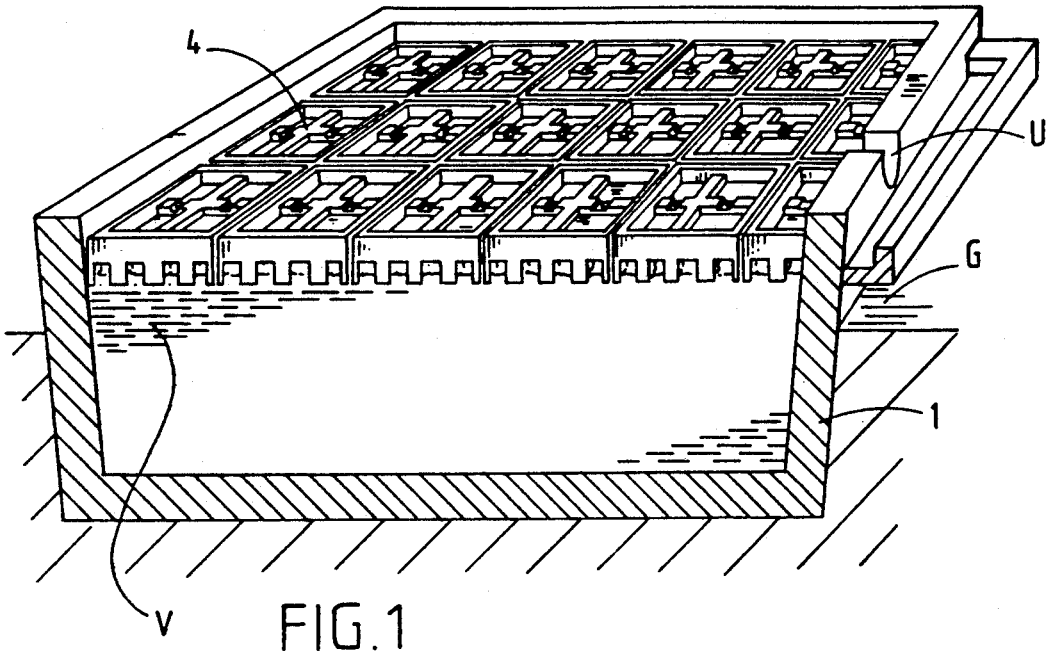

The invention relates to an apparatus for covering a basin for liquids, for instance basins used for purification of waste water.

The present invention aims to provide a covering apparatus, which can be easily handled, which does not require supporting constructions, and which covers sufficiently effectively the upper surface of a basin to avoid inconvenience by stench, and in which further the upper surface of the liquid is accessible allowing to remove flotation foam etc.

The apparatus according to the present invention distinguishes itself by at least one covering element of a certain thickness and with a regular polygonal circumference in top view, for instance a rectangle or a hexagon, etc., which covering element is provided of at least one floating member at its side adjacent to the liquid, so that the lower side of the covering element is on a certain distance from the surface of the liquid.

As a consequence of the elementary construction of the cover for the basin each element can be executed such that it can be located on the liquid surface of the basin by hand, in which the regular circumference of the element provides that most basins can be covered completely without incurring extra cutting. This is the more relevant if the element has been made of flexible material. Because the elements float on the liquid surface, the supporting of the element is not important, but the distance between the lower face of the covering element and the liquid surface allows draining or removal of bodies floating on the liquid.

In a preferred embodiment the floating elements are bodies extending downward from the lower side of the covering element and arranged according to a regular pattern. These can be manufactured together with the covering element as a single piece, but according to another embodiment they can be made of the material of the floating body and being adhered to that in a shifted position.

To avoid the elements being blown away by the wind it can be advantageous to range the upper surface of the covering element as a deepened tray, in which water can remain, functioning as ballast.

To obtain a smooth distribution of the ballast water at the upper side the tray can be provided with standing up ribs. Subsequently the tray can be provided with draining apertures serving to keep the depth of the layer of water constant.

Further the elements can be mutually connected by means of suitable connecting means.

Figure 2:
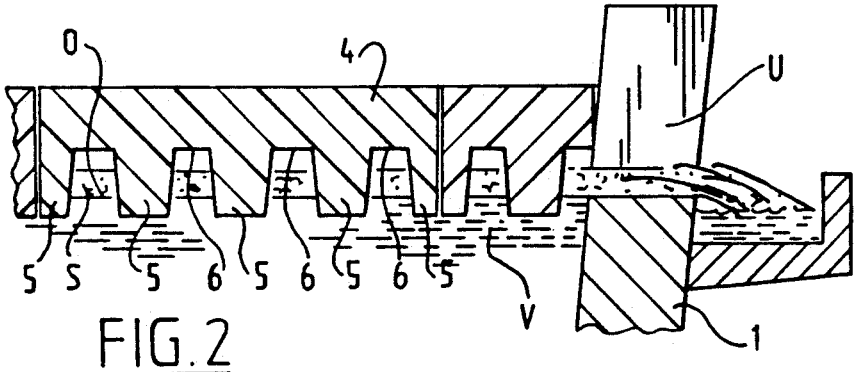
Figure 3:
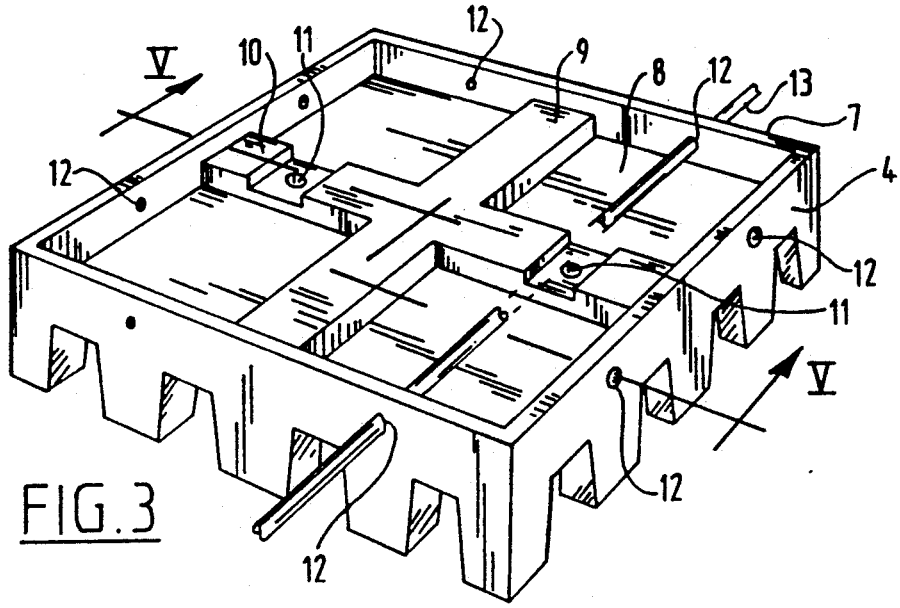
Figure 4:
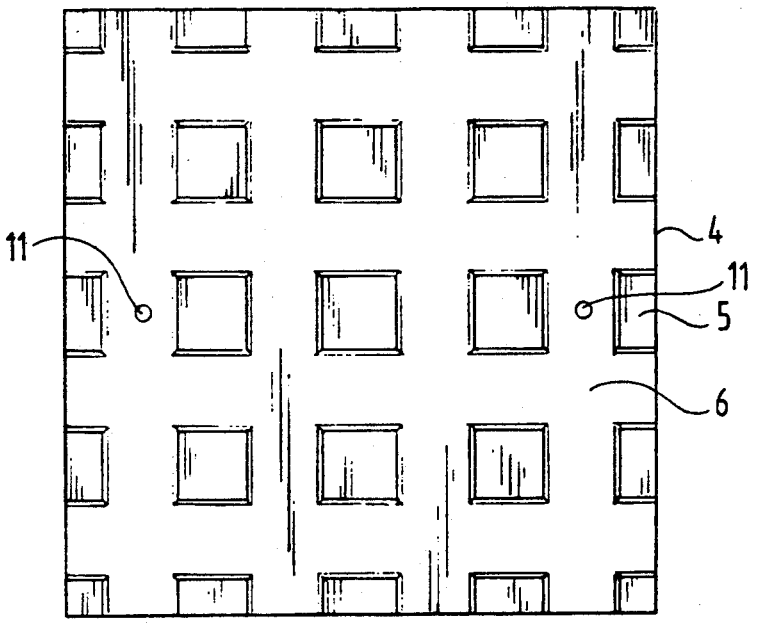
Figure 5:
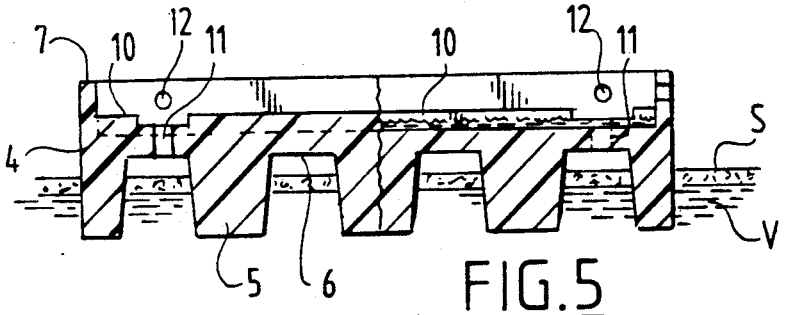
Figure 6:
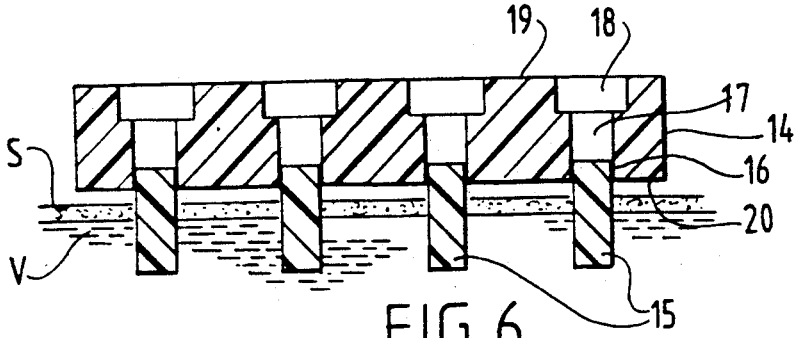

Subsequently the invention will be elucidated with the help of some embodiments depicted in the drawings. In the drawings show:

FIG. 1: a cross-section, partially in a top view from a basin comprising covering elements according to the invention;

FIG. 2: a cross-section of the basin from FIG. 1 on an enlarged scale;

FIG. 3: a perspective top view of a covering element according to the invention;

FIG. 4: a bottom view of the element depicted in FIG. 3;

FIG. 5: a cross-section of the covering element depicted in FIG. 3 according to the line V—V; and FIG. 6: a cross-section comparable with the cross-section depicted in FIG. 5, but of another embodiment.

Reference 1 indicates a basin, which normally is open at its top side and which is filled with a liquid V of indifferent nature. The basin is connected with a pipe system, not depicted, for supplying and draining respectively of the liquid, in which in FIG. 1 it is schematically indicated that the basin is deepened to some extend relative to the ground G.

The sizes in the horizontal direction can be several tens of meters for length and width respectively, which basins may be fit for storage of waste water in purification installations.

The surface of the water has to be sealed, which can take place by means of the covering elements 4 according to the present invention. The covering elements 4 have a regular shape, which appears from FIGS. 3 and 4, for instance quadrangular, so that a substantial number of these elements cover the whole surface of the liquid in the basin.

The covering body is shown in FIG. 2 in an enlarged scale and it consists of a solid body, which at its lower side is provided of floating bodies 5 extending downwardly. The floating bodies include an aggregate buoyancy sufficient to hold the lower face 6 of the covering element 5 above the surface O of the level V. Because the floating bodies 5 are not adjacent, but are arranged according to a regular pattern as shown in FIG. 4 at the bottom side of the covering element 4 channels developed in the element 4 extending in the length- and perpendicular direction respectively, through which foam as possibly present on the liquid can be removed sidewardly through a drain opening U of the basin 1. This foam develops for instance as a consequence of certain chemical processes in the liquid V in the basin 1. The elements are proof against possible curls or turbulences in the liquid V, so that the liquid can be processed with known agitation means, without disturbing the covering according to the invention.

The upper surface 7 of the element 4 has the shape of a tray as shown in FIG. 3, in which the deepened part 8 is on a certain distance below the circumferencial rim. The deepened part 8 comprises a rib 9 extending longitudinally and/or extending perpendicularly, which devides the complete surface of this element in four equally shaped parts, so that during rain, water can be stored in said deepened parts. The rib 10 contains a drain aperture 11, which extends vertically until the lower face 6, so that in the case of superfluous rain this can be drained through drain opening 11, as is shown in FIG. 5.

Also drain apertures 12 can be provided in the side wall of the tray, which apertures can also serve as connection means for mutually connecting of these elements when they are floating on the surface of the liquid. Through these apertures 12 rods 13 can be inserted, so that rows of elements can be connected.

These rods can also serve as a support for possible walking planks, etc.

FIG. 6 shows an embodiment, in which the floating body 15 can be formed from the material of the elements 14 by removing this material with a hollow drill and by subsequently attaching the core of the hollow drill at the location 16 to the material of the element 14 by a suitable connection means, for instance an adhesive. The remaining aperture 17 can serve as a blind hole, which may serve as a chamber for ballast liquid like rain water. Possibly the blind chamber 17 can be broadened at the upper side with the part 18, so that relative small rims 19 between the chambers 18 develop.

The chambers 18 can be a circular or rectangular, in which the chambers 17 are preferably circular in cross-section.

Also in the embodiment according to FIG. 6 the floating force of all floating bodies 15 is commonly sufficient to maintain the lower surface 20 of the element 14 above the upper surface of foam layer S.

In all embodiments it is preferred to choose the material for the element 4, 14 such, that it has a specific gravity which is smaller than 1, for instance foamed plastics etc. Foamed material is not only gas tight (closed cells), but also flexible and resilient, so that the element 4 may adapt easily to the side walls of the basin 1 if the level of the liquid moves upward or downward. Even when the rows of elements do not exactly fit in the inner size of the basin 1 these elements can be pressed into a certain extent to nevertheless completely cover the upper surface of the liquid.

The invention is not restricted to the embodiment described above.

We claim:

1. Apparatus for covering a basin for liquids, said liquids having a surface, the apparatus characterized by at least one covering element of a certain thickness of which the circumferencial shape in top view is regular, in which each covering element includes an upper side and a lower face for facing the liquids in the basin;

wherein the covering element is provided with a plurality of solid buoyant elements at the lower face, and spaced apart from one another to form intersecting channels with the lower face of the covering element; and wherein the solid buoyant elements include sufficient aggregate buoyancy to float the lower face of the cover above the surface of the liquid and thereby allow passage of buoyant materials within the liquid along the channels.

2. Apparatus according to claim 1, characterized in that the solid buoyant elements are bodies arranged according to a regular pattern, provided at the lower face of the covering element.

3. Apparatus according to claim 1, characterized in that the covering element and the solid buoyant elements are integral.

4. Apparatus according to claim 1, characterized in that each solid buoyant element is formed from the covering element and is fixed in a shifted position to said covering element.

5. Apparatus according to claim 1, characterized in that the upper side of the covering element includes an upwardly open recessed configuration.

6. Apparatus according to claim 5, characterized in that the upper side further includes ribs on the upper cover side and having a height dimension extending across the recessed configuration.

7. Apparatus according to claim 6, characterized in that the upper side includes a raised peripheral rim extending to a height above the upper surface and wherein the height of the ribs is lower than the height of the rim.

8. Apparatus according to claim 6, characterized in that one or more draining apertures have been provided in the ribs.

9. Apparatus according to claim 1, characterized in that each element has been manufactured from a foamed plastic.

* * * * *